US009512989B2

(12) United States Patent
Dellian

(10) Patent No.: US 9,512,989 B2
(45) Date of Patent: Dec. 6, 2016

(54) LAMP ARRANGEMENT

(75) Inventor: Harald Dellian, Edling (DE)

(73) Assignee: OSRAM GMBH, Munich (DE)

( * ) Notice: Subject to any disclaimer, the term of this patent is extended or adjusted under 35 U.S.C. 154(b) by 782 days.

(21) Appl. No.: 13/580,162

(22) PCT Filed: Mar. 4, 2011

(86) PCT No.: PCT/EP2011/053262
§ 371 (c)(1),
(2), (4) Date: Aug. 21, 2012

(87) PCT Pub. No.: WO2011/113709
PCT Pub. Date: Sep. 22, 2011

(65) Prior Publication Data

US 2013/0002146 A1 Jan. 3, 2013

(30) Foreign Application Priority Data

Mar. 18, 2010 (DE) ..... 10 2010 002 996

(51) Int. Cl.

| | |
|---|---|
| ***H05B 37/02*** | (2006.01) |
| ***F21V 19/00*** | (2006.01) |
| ***F21V 25/04*** | (2006.01) |
| ***H01R 33/94*** | (2006.01) |
| ***F21K 99/00*** | (2016.01) |
| *F21Y 101/02* | (2006.01) |
| *F21Y 103/00* | (2016.01) |

(52) U.S. Cl.
CPC ..... *F21V 19/008* (2013.01); *F21K 9/175* (2013.01); *F21V 25/04* (2013.01); *H01R 33/942* (2013.01); *F21Y 2101/02* (2013.01); *F21Y 2103/003* (2013.01)

(58) Field of Classification Search
CPC ..... F21K 9/17
See application file for complete search history.

(56) References Cited

U.S. PATENT DOCUMENTS

| | | | | |
|---|---|---|---|---|
| 7,053,557 | B2 | 5/2006 | Cross et al. | |
| 7,358,679 | B2 * | 4/2008 | Lys et al. | 315/51 |
| 7,780,307 | B2 | 8/2010 | Lin | |
| 8,072,129 | B2 * | 12/2011 | Custodis et al. | 313/318.01 |
| 8,324,817 | B2 * | 12/2012 | Ivey et al. | 315/151 |

(Continued)

FOREIGN PATENT DOCUMENTS

| | | |
|---|---|---|
| DE | 201041717 U1 | 6/2001 |
| DE | 20320047 U1 | 4/2004 |

(Continued)

OTHER PUBLICATIONS

English abstract of JP 2008108598 A.

(Continued)

*Primary Examiner* — Ryan Jager
(74) *Attorney, Agent, or Firm* — Viering, Jentschura & Partner MBB

(57) ABSTRACT

In various embodiments, a lamp arrangement with a lamp including a base which is able to be inserted into a socket for establishing contact with the lamp, wherein the lamp arrangement has at least one operating element for setting a property of the lamp, wherein the at least one operating element is not accessible when the lamp is being used in the intended manner.

12 Claims, 5 Drawing Sheets

(56) References Cited

U.S. PATENT DOCUMENTS

Figure 1:
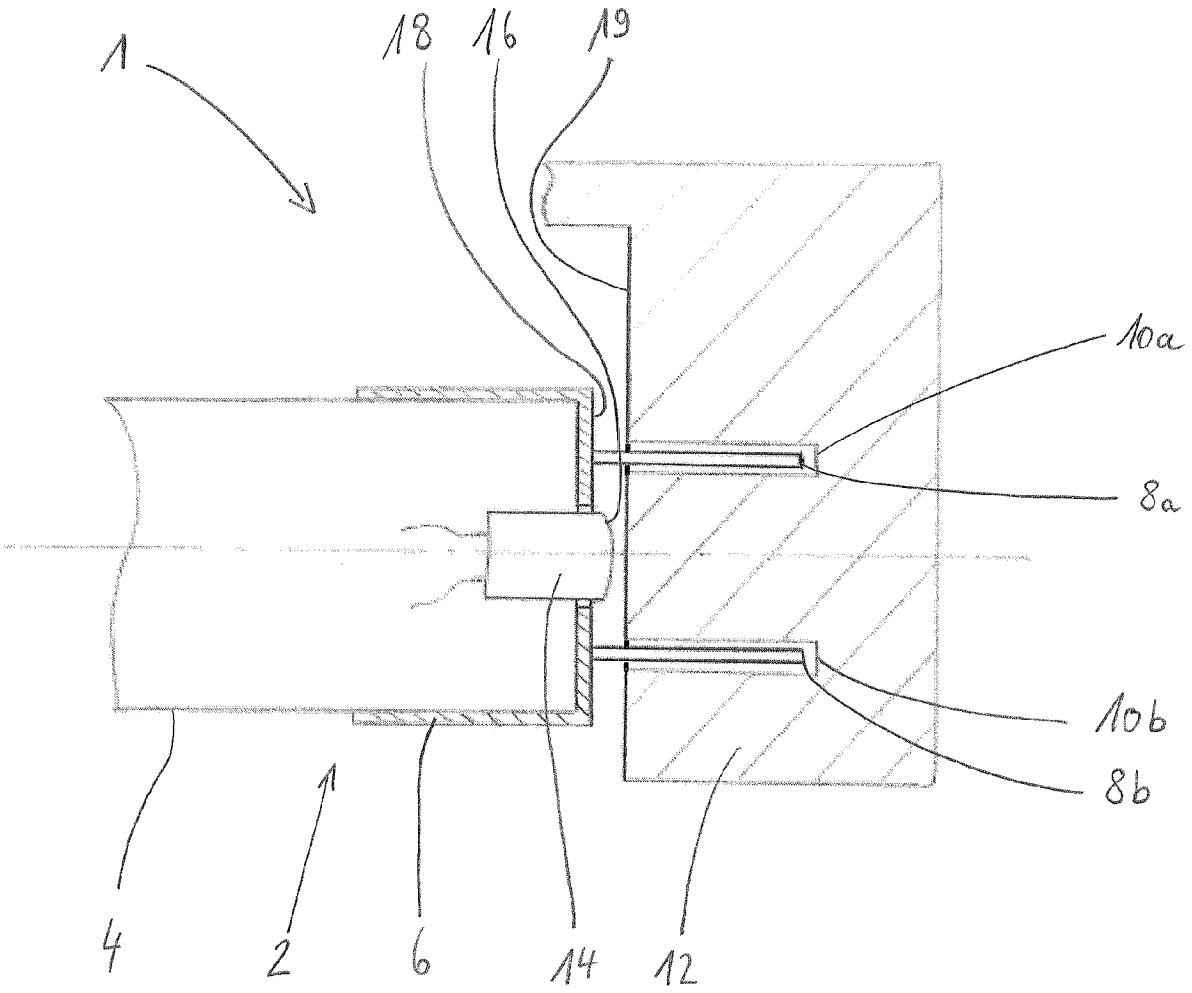

| | | | | |
|---|---|---|---|---|
| 8,531,109 | B2 * | 9/2013 | Visser et al. | 315/88 |
| 2004/0170015 | A1 * | 9/2004 | Hamrick | 362/230 |
| 2006/0238136 | A1 | 10/2006 | Johnson, III et al. | |
| 2007/0086199 | A1 | 4/2007 | Demarest et al. | |
| 2007/0223225 | A1 | 9/2007 | Eiich et al. | |
| 2007/0297169 | A1 | 12/2007 | Holmes | |
| 2010/0289428 | A1 * | 11/2010 | Frazier et al. | 315/294 |
| 2011/0149564 | A1 * | 6/2011 | Hsia et al. | 362/221 |
| 2012/0043909 | A1 * | 2/2012 | Bloom et al. | 315/294 |
| 2012/0127692 | A1 * | 5/2012 | Chien | 362/84 |
| 2014/0239844 | A1 * | 8/2014 | Bruwer | 315/292 |

FOREIGN PATENT DOCUMENTS

| | | | |
|---|---|---|---|
| DE | 102005032315 | A1 | 1/2007 |
| DE | 602004009684 | T2 | 2/2008 |
| DE | 202008013427 | U1 | 2/2009 |
| DE | 202008015948 | U1 | 4/2009 |
| DE | 202010008186 | U1 | 11/2010 |
| EP | 1484550 | A1 | 12/2004 |
| JP | 2008108598 | A | 5/2008 |
| JP | 2009158533 | A | 7/2009 |
| WO | 2010021675 | A1 | 2/2010 |
| WO | WO 2010021675 | A1 * | 2/2010 |

OTHER PUBLICATIONS

English abstract of DE 20320047 U1.
English abstract of EP 1484550 A1.
English abstract of JP 2009158533 A.

* cited by examiner

LAMP ARRANGEMENT

RELATED APPLICATIONS

The present application is a national stage entry according to 35 U.S.C. §371 of PCT application No.: PCT/EP2011/053262 filed on Mar. 4, 2011, which claims priority from German application No.: 10 2010 002 996.3 filed on Mar. 18, 2010.

TECHNICAL FIELD

Various embodiments relate to a lamp arrangement.

BACKGROUND

Fluorescent or low-pressure gas discharge lamp arrangements, because of their high light output and long life, make a major contribution to lighting in general. Mercury in a vapor phase is to be found in the discharge vessel of a fluorescent lamp. The processes of ionization and excitation of the atoms of the mercury vapor produce a stream of electrons on the one hand and UV radiation on the other hand, which, on striking an illuminant coating of the lamp, is converted into visible light.

The disadvantage of fluorescent lamps is that, because of the poisonous mercury vapor that they contain, they present a major risk to people and to the environment. This risk must be countered by suitable measures, seamlessly and throughout the entire life of a fluorescent lamp. This means that the appropriate safety precautions have to be observed during production, packaging, storage, and commercial transport right through to use by a user and correct disposal and this creates significant effort and costs.

Document U.S. Pat. No. 7,053,557 B2 discloses a lamp arrangement with tubular LED lamps which can replace the fluorescent lamps described above. In the LED lamps a number of LEDs are arranged along the longitudinal axis. In these lamps they emit white or colored light depending on their construction. Disposing LEDs of different colors in the lamps is likewise known in order, via a suitable control, to generate a light output of any given light colors by mixing the colors of the individual LEDs. The LED lamps are contacted in each case via a base embodied at the ends of their glass bulb. The lamp bases are embodied in such cases so that they can be inserted into the existing sockets of fluorescent lamps.

Document JP 2008108598 AA discloses a remote control unit for controlling the light color of LED lamps containing LEDs in different colors. With control buttons arranged on the remote control unit the operator adjusts the radiation power of the respective different colored LEDs. This setting produces a light color of the LED lamp.

As well as the option of setting the lamp properties by a remote control, it is also possible to arrange control elements on the lamp, or on the lamp arrangement, into which the lamp is built for this purpose.

An exemplary embodiment for a remotely-controlled LED lamp arrangement is the Color e-Motion system from OSRAM.

The said lamps and lamp arrangements have in common that properties of the lamps, such as switched on/switched off for example, the brightness or the light color, can be set via a control unit which is accessible at any time during the operation of the lamp and is thus easy to set incorrectly.

The disadvantage of this solution is that the properties of the lamp can be incorrectly set during operation by mistake, by chance or by unauthorized persons for example.

SUMMARY

Various embodiments may increase security against random, undesired or unauthorized changes to properties of the lamp.

In various embodiments, a lamp arrangement features a lamp having a base, which for contacting the lamp is able to be inserted into a socket. In this case the lamp arrangement has at least one operating element for setting the property of the lamp. The at least one operating element is not accessible when the lamp is being used as intended.

This inventive lamp arrangement has the advantage over the prior art explained at the outset that, when the lamp is being used as intended in the lamp arrangement, random, undesired adjustment of its properties is not possible. The properties of the lamp can only be changed by the at least one operating element if the intended use is interrupted for this purpose. An inadvertent change of properties is largely prevented by this. Use as intended in this case is to be seen as especially any use of the lamp arrangement in which the lamp arrangement is able to emit light and in which the lamp arrangement, in accordance with technical, especially safety regulations for operating corresponding lamps, is arranged, built-in and/or connected. Especially in such cases the lamp is held in a socket for operation with ac mains voltage.

Advantageously the operating element is disposed on an outer side of the lamp arrangement. This allows good access, provided the lamp arrangement is not in the state provided for its intended use, i.e. not installed in a light fitting for example. In particular the operating element is thus arranged so that it is not necessary to open up the lamp arrangement to operate the operating element.

Preferably an operating element is disposed on the base of the lamp and/or on the socket.

If the base of the lamp is inserted into the socket a zone is formed in an area of the base and the socket which is inaccessible. If the operating element is positioned in this zone, incorrect setting of the operating element after insertion of the base of the lamp into the socket is no longer possible. Incorrect setting is thus safely prevented simply by clever spatial positioning of the operating element. The advantage of this is that, as well as the already existing base and the existing socket, no further measurements or facilities for preventing inadvertent changes to the operating element are necessary. Since the operating element arranged in this zone is only accessible if the base of the lamp is not inserted into the socket it can only be touched or operated in the non-powered state of the lamp. This has the particular advantage that the operating element does not have to conform to any IEC standards and can therefore be embodied more simply and at lower cost. It is also of advantage that the operating element which is arranged in this zone and is not visible to an external observer has no effect on the aesthetic look and feel of the lamp.

The inventive lamp arrangement is used in a preferred way if an LED lamp such as for example a tubular LED tube is installed as the lamp.

An advantage of LED lamps over other conventional lamps is that they do not need a gas-tight base.

LED lamps are also characterized in that their light properties can be changed with little technical effort simply, precisely and in an easy-to-reproduce manner. Thus for example, when LEDs of different colors are used in an LED lamp, the color of their light can be set precisely. Likewise in the dimming of the brightness of an LED lamp the original color temperature of the light can be kept constant very precisely.

Advantageously the lamp of the lamp arrangement has bases at both ends.

A lamp with two bases has an additional base and an additional socket. This means that there is an additional zone available in which the operating elements can be disposed.

It is advantageous for two or more contact pins to be disposed on at least one base of the lamp and for the operating element to be disposed in the area between the contact pins.

If the operating element is located in this area, even in the removed state of the lamp it is only accessible with difficulty. The contact pins close to the operating element screen the operating element at least partly from accidental actuation.

If the bases of the lamp are embodied so that they are able to be inserted into sockets embodied conventionally for tubular fluorescent lamps, the inventive protection against accidental incorrect setting can be advantageously employed in a wide area of general-purpose lighting, since a significant number of current light fittings have sockets for fluorescent lamps.

In a very advantageous arrangement of the operating element, the outer operating side of the operating element disposed in the base makes approximately flush contact with an outer surface of the base. The same advantage is produced if an outer operating side of the operating element disposed in the socket makes approximately flush contact with an outer surface of the socket.

The flush contact has the effect of making it difficult to access and adjust the lamp in the removed state of the lamp. Incorrect setting of the operating element through for example impact or undesired contact is thereby countered in this state of the lamp.

Advantageous embodiments of the operating element are for example a switch or a rotary potentiometer.

A further option for controlling the ability of the operating element to be incorrectly set in the removed state of the lamp is to only make it possible to change the setting with the aid of tools or other aids.

Thus the operating elements can be designed for example so that they are only able to be adjusted by using screwdrivers, adjustment plates or other tools.

Preferably the light color property or the color temperature or the switch-on and/or switch-off point of the lamp are set via the operating element.

An especially advantageous use of the inventive incorrect setting prevention is provided for lamp arrangements having a sensor arrangement available to them, of which the response behavior can be adjusted by the operating element. Movement detectors or brightness sensors are conceivable as sensors for example.

Thus for example the operating element which defines the brightness threshold of a light intensity sensor for the switching on or switching off the lamp, or which defines the reduction in power in the lamp as a function of the ambient brightness detected by the sensor, can be embodied in an inventive manner to prevent incorrect setting. Likewise the operating elements which activate or deactivate a movement detector or which define its capture area can be protected from change in the said manner.

BRIEF DESCRIPTION OF THE DRAWING(S)

Figure 2:
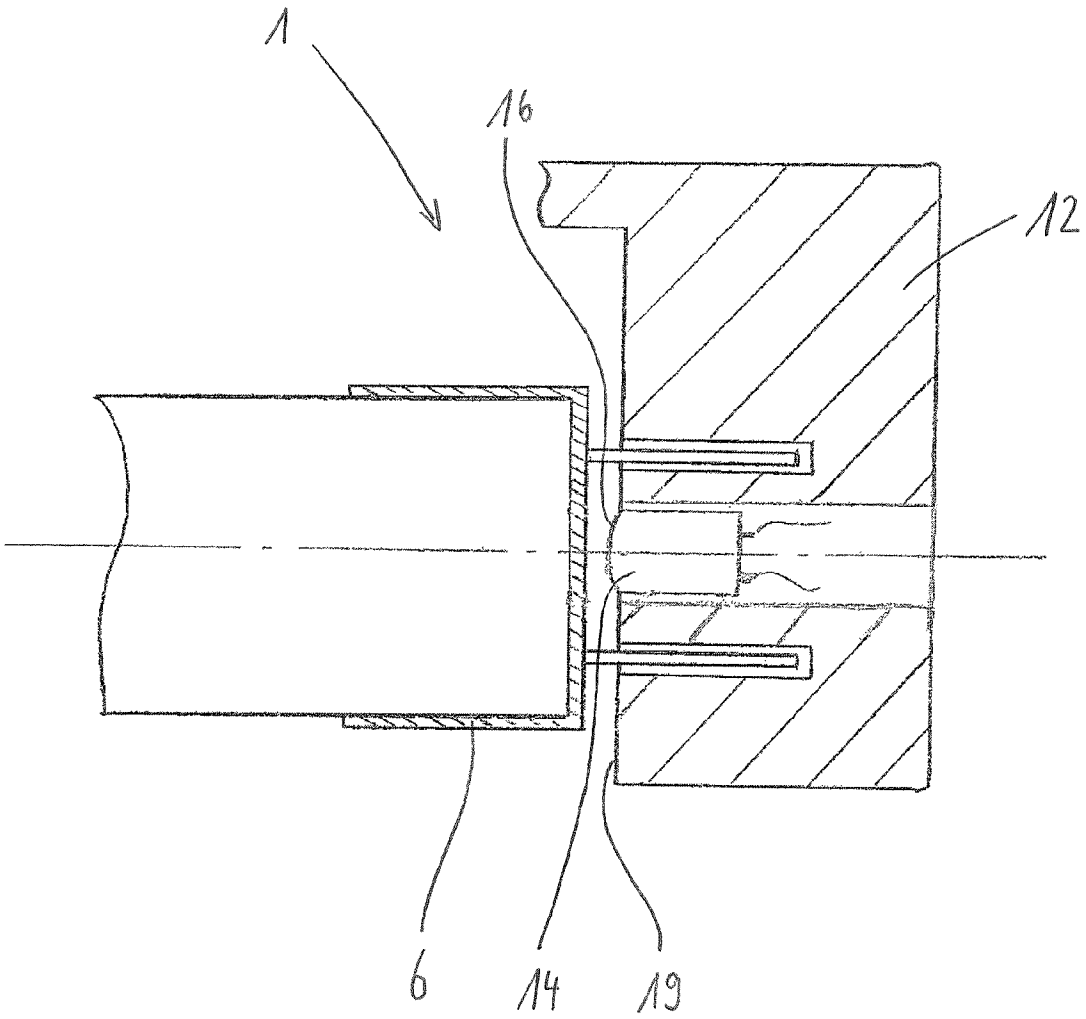
Figure 3:
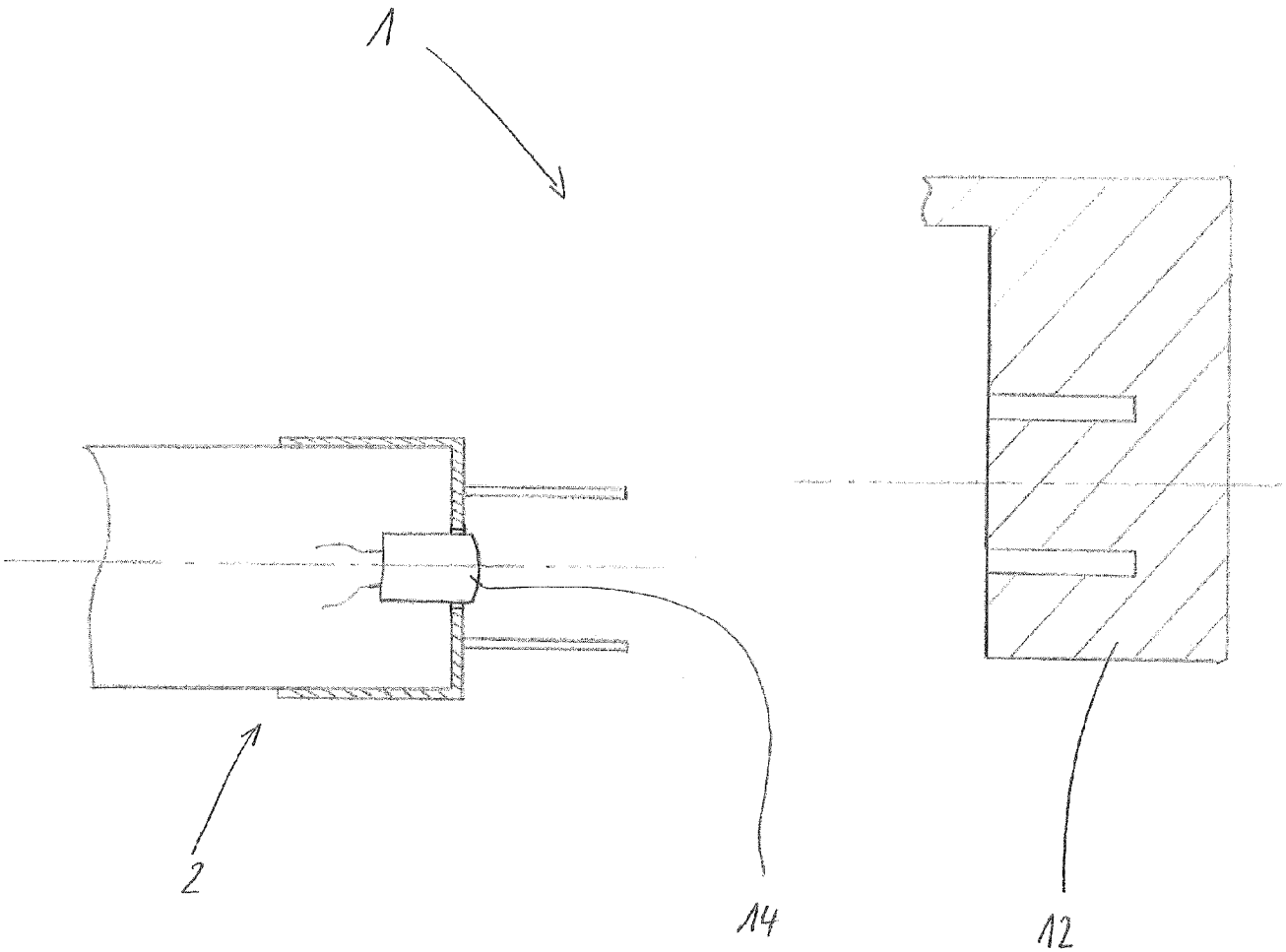
Figure 4:
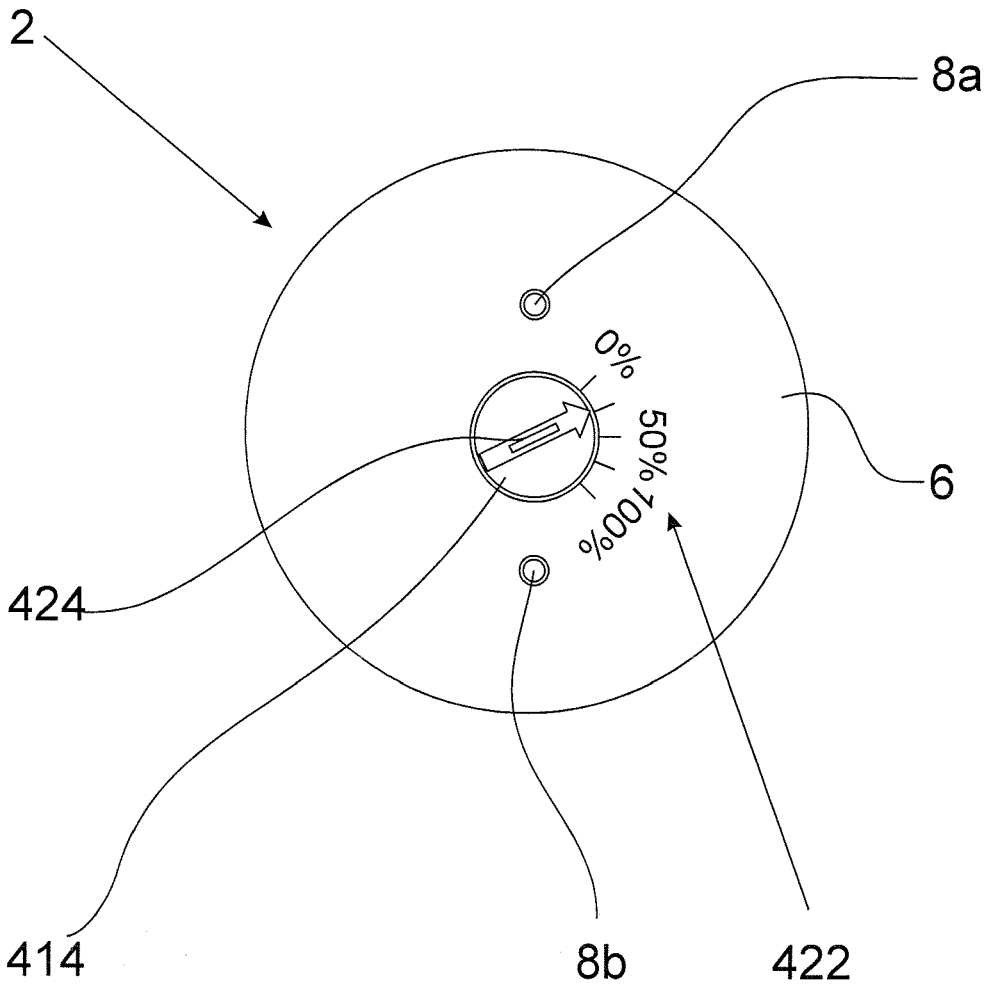
Figure 5:
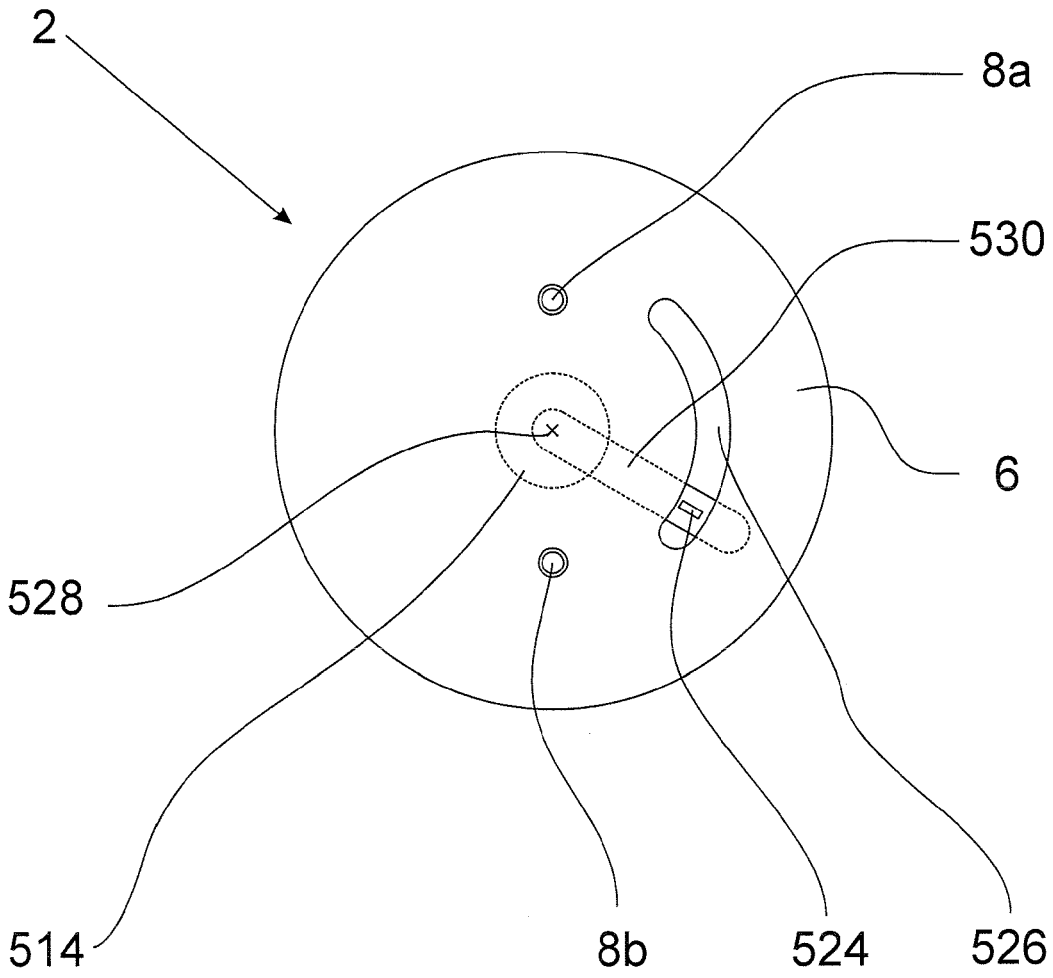

In the drawings, like reference characters generally refer to the same parts throughtout the different views. The drawings are not necessarily to scale, emphasis instead generally being placed upon illustrating the principles of the invention. In the following description, various embodiments of the invention are described with reference to the following drawings, in which:

FIG. 1 a schematic longitudinal section of a first exemplary embodiment of an inventive lamp arrangement (lamp, base, socket, switch in base);

FIG. 2 a schematic longitudinal section of a second exemplary embodiment of a lamp arrangement (lamp, base, socket, switch in socket);

FIG. 3 a schematic longitudinal section of a lamp arrangement in accordance with the first exemplary embodiment (lamp, base, socket, switch in base, lamp in non-inserted state);

FIG. 4 a schematic view from above of a third exemplary embodiment of an inventive lamp arrangement (base with rotary potentiometer, without socket);

FIG. 5 a schematic view from above of a fourth exemplary embodiment of an inventive lamp arrangement (base with rotary potentiometer, without socket).

DETAILED DESCRIPTION

The following detailed description refers to the accompanying drawings that show, by way of illustration, specific details and embodiments in which the invention may be practiced.

A lamp arrangement in accordance with the prior art has a remote control unit with which the properties light color, color temperature and brightness of the lamp can be set. An example of such an arrangement is the Color e-Motion Tube RGB system from OSRAM. A module of this system consists of an elongated socket in which an LED light strip is disposed. The properties of the LED light strip or the LED lamp can be set via a wallmount unit installed in a fixed location or via an infrared remote control.

FIG. 1 shows in a schematic longitudinal sectional view an inventive lamp arrangement 1 in accordance with a first exemplary embodiment. A lamp 2, consisting of a lamp vessel 4 and a base 6, is accommodated by two contact pins 8*a*, 8*b* in two contact receptacles 10*a*, 10*b* of a socket 12. The two contact pins 8*a*, 8*b* in their contact receptacles 10*a*, 10*b* serve in this case both to secure the lamp 2 in the socket 12 and also for electrical contacting of the lamp 2 with the socket 12. In the base 6 of the lamp 2 an operating element is located centrally between the contact pins 8*a*, 8*b* which is embodied as a switch 14 and which is used for setting a property of the lamp 2. In an intended use of the lamp 2 as shown, in which it is inserted into its socket 12, the switch 14 is not accessible to a user from the outside and can therefore not be set incorrectly.

One use of such a switch 14 is for example a movement detector which switches on, activates or deactivates the lamp 2 as a function of detected movements in the surroundings of the lamp arrangement 1. The switch 14 is positioned in FIG. 1 so that an outer operating side 16 of the switch 14 projects slightly above a surface 18 of the base 6.

FIG. 2 shows in a schematic longitudinal view the inventive lamp arrangement 1 in accordance with a second exemplary embodiment, in which the switch 14, as an alternative to FIG. 1, is not disposed in the base 6 but in the socket 12. The switch 14 is positioned in FIG. 2 so that an outer operating side 16 of the switch 14 projects slightly above a surface 19 of the socket 12.

FIG. 3 shows the lamp 2 of the lamp arrangement 1 not being used as intended or disposed outside its socket 12.

Only this state of the lamp arrangement 1 offers a user the opportunity of adjusting a property of the lamp 2 via the switch 14. The arrangement of the switch 14 between the contact pins 8*a*, 8*b*, in this dismantled state of the lamp 2, prevents an inadvertent or undesired incorrect setting of the switch 14 by the user.

FIG. 4 shows a third exemplary embodiment of the base 6 of the lamp 2 viewed from above, with a rotary potentiometer 414 as operating element. This enables a property of the lamp 2 to be adjusted on a scale 422 between 0% and 100%. The rotary potentiometer 414 is disposed in this case centrally between the contact pins 8*a*, 8*b* of the lamp 2 and has a slot 424, to which the user can apply a screwdriver or and adjustment plate for adjusting the rotary potentiometer 414.

Applications for the rotary potentiometer 414 are for example setting a capture range or a capture angle of the sensor of a movement sensor arrangement integrated into the lamp 2 steplessly between a minimum and a maximum value. As an alternative, the response threshold of a brightness sensor can be adjusted by the rotary potentiometer 414 which defines the brightness value from which the movement sensor arrangement will be activated or deactivated. Furthermore the rotary potentiometer 414 can be used to set a delay time which defines how long the lamp remains switched on after the last movement is detected in the surroundings of the movement sensor arrangement.

FIG. 5 shows a fourth exemplary embodiment of the base 6 of the lamp 2 viewed from above with a rotary potentiometer 514 to be operated in an alternative manner. This is adjusted with the aid of a tool which is inserted into a slot 524 and is moved along a groove 526 on a circular path around an axis of rotation 528. Via a lever 530 a rotary potentiometer 514 lying behind the base 6 produces its adjustment value.

As an alternative to the rotary potentiometers 414, 514 and switches 14 shown, further and/or other suitable operating elements can be disposed on the base 6 and/or on the socket 12.

With increased outlay in terms of apparatus the positioning of the operating elements in the area of the base 6 and the socket 12 shown is also able to be used with lamp arrangements 1 with fluorescent lamps.

Base-socket pairs other than those shown are also conceivable, especially plug-in lamp bases, such as G10 or GX24, screw bases, such as E27 or E14 for example, or bayonet bases, such as B22*d* for example.

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

The invention claimed is:

1. A lamp configured to emit light; wherein the lamp comprises:

a base which is able to be inserted into a socket for establishing contact with the lamp, and a movement sensor arrangement comprising at least one of a movement detector and/or a brightness sensor;

wherein the lamp has at least one operating element configured for adjusting a property of the emitted light from the lamp, wherein the property is selected from the group consisting of:

setting a capture range or a capture angle of the movement sensor arrangement integrated into the lamp;

setting a delay time where the lamp remains switched on after the last movement detected by the movement sensor arrangement; and combinations thereof;

wherein the at least one operating element is not controllable when the lamp is being used in the intended manner.

2. The lamp arrangement as claimed in claim 1, wherein the at least one operating element is disposed at least one of on the base and on the socket.

3. The lamp arrangement as claimed in claim 1, wherein the lamp is a light emitting diode lamp or a light emitting diode tube.

4. The lamp arrangement as claimed in claim 1, wherein the lamp has bases on both sides.

5. The lamp arrangement as claimed in claim 4, wherein at least two contact pins are disposed on at least one base of the lamp and wherein at least one operating element is disposed in the area between the contact pins;

with the bases being embodied so that they are able to be inserted into conventional sockets embodied for tubular fluorescent lamps.

6. The lamp arrangement as claimed in claim 1, wherein at least two contact pins are disposed on at least one base of the lamp and wherein at least one operating element is disposed in the area between the contact pins.

7. The lamp arrangement as claimed in claim 1, wherein an outer operating side of the operating element disposed in the base is approximately flush with an outer surface of the base.

8. The lamp arrangement as claimed in claim 1, wherein the operating element is one of a switch and a rotary potentiometer.

9. The lamp arrangement as claimed in claim 1, wherein the operating element is able to be adjusted by a tool.

10. The lamp arrangement as claimed in claim 9, wherein the tool comprises one of a screwdriver and a small adjustment plate.

11. The lamp arrangement as claimed in claim 1, wherein one of a light color; a color temperature; and a switch-on and switch-off time is able to be set by an operating element.

12. The lamp arrangement as claimed in claim 1, wherein an outer operating side of the operating elements disposed in the socket is approximately flush with an outer surface of the socket.

* * * * *